US009701091B2

(12) United States Patent
Page et al.

(10) Patent No.: US 9,701,091 B2
(45) Date of Patent: Jul. 11, 2017

(54) APPARATUS AND METHOD FOR DISPENSING CUSHIONING WRAP MATERIAL

(71) Applicant: Ranpak Corp., Concord Township, OH (US)

(72) Inventors: Brandon Cadette Page, Durham, NC (US); Marcelo Miller Passos, Morrisville, NC (US); Matthew Scott Gardner, Four Oaks, NC (US)

(73) Assignee: Ranpak Corp., Painesville, OH (US)

( * ) Notice: Subject to any disclaimer, the term of this patent is extended or adjusted under 35 U.S.C. 154(b) by 166 days.

(21) Appl. No.: 14/415,724

(22) PCT Filed: Jul. 16, 2013

(86) PCT No.: PCT/US2013/050672
§ 371 (c)(1),
(2) Date: Jan. 19, 2015

(87) PCT Pub. No.: WO2014/014905
PCT Pub. Date: Jan. 23, 2014

(65) Prior Publication Data

US 2015/0165717 A1 Jun. 18, 2015

Related U.S. Application Data

(60) Provisional application No. 61/673,278, filed on Jul. 19, 2012.

(51) Int. Cl.
*B31D 5/00* (2017.01)
*B65H 16/00* (2006.01)
(Continued)

(52) U.S. Cl.
CPC ..... *B31D 5/0065* (2013.01); *B65H 16/005* (2013.01); *B31D 2205/007* (2013.01);
(Continued)

(58) Field of Classification Search
CPC .... B31D 2205/0023; B31D 2205/0082; B31D 2205/0047; B31D 5/0065; B65H 75/185
(Continued)

(56) References Cited

U.S. PATENT DOCUMENTS 1,028,506 A * 6/1912 Thieme ..... B65H 49/32 242/129.6
1,082,337 A * 12/1913 Kallam ..... B65H 75/18 33/733
(Continued)

OTHER PUBLICATIONS

International Search Report of corresponding International Application No. PCT/US2013/050672, dated Oct. 7, 2013.
(Continued)

*Primary Examiner* — Emmanuel M Marcelo
*Assistant Examiner* — Michael Gallion
(74) *Attorney, Agent, or Firm* — Renner, Otto, Boisselle & Sklar, LLP

(57) ABSTRACT

An unpowered, manually operable apparatus (10) for dispensing cushioning wrap material (13) includes a frame (12), a roll (14) of interleaf material (16) rotatably secured to the frame, a roll (18) of expandable sheet material (20) in an unexpanded form rotatably secured to the frame adjacent the roll of interleaf material, and a tensioning assembly (60, 70, 80, 90) operably associated with the roll of expandable sheet material to control rotational resistance thereof. The rotational resistance causes the expandable sheet material to expand in length and thickness as it is pulled with the interleaf material by a user. Typically, the roll of interleaf material and the roll of expandable sheet material are secured to the frame such that respective longitudinal centerlines of each roll are substantially aligned. In addition, typically, the axial directions of the rolls are substantially parallel.

20 Claims, 6 Drawing Sheets

(51) Int. Cl.
*B65H 75/18* (2006.01)
*B65H 16/06* (2006.01)

(52) U.S. Cl.
CPC ..... *B31D 2205/0023* (2013.01); *B31D 2205/0047* (2013.01); *B31D 2205/0058* (2013.01); *B31D 2205/0064* (2013.01); *B65H 16/06* (2013.01); *B65H 75/185* (2013.01)

(58) Field of Classification Search
USPC ..... 242/530–530.3; 493/350, 352, 407, 904
See application file for complete search history.

(56) References Cited

U.S. PATENT DOCUMENTS 1,693,876 A * 12/1928 Unruh, Jr. ..... B65H 75/08 242/129.51
2,600,153 A * 6/1952 Breitenstein ..... G07C 3/12 242/548.3
2,904,279 A * 9/1959 Ewing ..... B65H 75/242 242/573.2
2,983,459 A * 5/1961 Gray ..... H01F 41/063 242/422.4
3,099,117 A * 7/1963 Christiansen ..... B21C 47/34 242/559.1
3,466,733 A * 9/1969 Barsam ..... B64C 25/64 29/896.93
3,642,967 A * 2/1972 Doll ..... B29C 44/5636 220/676
3,680,804 A * 8/1972 Aaron ..... B65H 19/2207 242/530
3,703,430 A * 11/1972 Rich ..... B29C 65/18 156/497
3,730,452 A * 5/1973 Schwartz ..... B65H 75/08 242/598.3
3,771,738 A * 11/1973 Abbey ..... B21C 47/006 226/191
3,912,189 A * 10/1975 Bauer ..... B65H 16/06 139/109
3,938,671 A * 2/1976 Lewey ..... B65H 16/06 414/14
4,026,487 A * 5/1977 Ales, Jr. ..... B65H 16/106 242/542.4
4,124,174 A * 11/1978 Kelly ..... A01K 89/027 242/246
4,237,776 A * 12/1980 Ottaviano ..... B26D 1/06 493/382
4,378,095 A * 3/1983 Reynolds ..... B65H 16/06 242/578.1
4,839,210 A * 6/1989 Komaransky ..... B31D 5/0047 206/412
5,203,761 A * 4/1993 Reichental ..... B26D 1/185 493/346
5,513,920 A * 5/1996 Whritenor ..... B41J 17/16 242/607
5,538,778 A * 7/1996 Hurwitz ..... B31C 5/00 206/521
5,575,435 A * 11/1996 Sperry ..... B29C 44/182 242/420.5
5,593,376 A * 1/1997 Armington ..... B31D 5/0047 493/346
5,651,510 A * 7/1997 Eble ..... B65H 54/106 242/129
5,688,578 A * 11/1997 Goodrich ..... B21D 31/04 206/521
5,714,107 A * 2/1998 Levy ..... D04H 1/70 264/146
5,727,370 A * 3/1998 Sperry ..... B29C 44/182 53/122
5,730,389 A * 3/1998 Biagiotti ..... B65H 19/1852 156/502
5,782,735 A * 7/1998 Goodrich ..... B31D 1/0031 225/100
5,816,165 A * 10/1998 Huston ..... B65H 26/06 101/485
6,282,807 B1 * 9/2001 Johnson ..... B65D 83/0841 116/200
6,375,116 B1 * 4/2002 Askins ..... B65H 75/185 242/599.2
6,402,085 B1 * 6/2002 Smith ..... A47K 10/40 242/578
6,402,674 B1 * 6/2002 Simmons, Jr. ..... B31D 5/0047 493/24
6,435,446 B1 * 8/2002 Matsuzawa ..... B65H 16/00 242/422.4
6,607,110 B2 * 8/2003 Nusbaum ..... B65D 83/0882 225/18
6,910,997 B1 * 6/2005 Yampolsky ..... B26F 1/22 493/350
7,331,542 B2 * 2/2008 Cocciadiferro ..... B65H 19/10 242/578
7,651,455 B2 * 1/2010 Yampolsky ..... B26F 1/22 493/407
7,735,685 B2 * 6/2010 Bertram ..... B29B 7/7678 222/135
7,972,071 B2 * 7/2011 Mindler ..... B41J 17/32 242/578
8,827,197 B2 * 9/2014 Powers ..... B32B 1/08 242/412
9,205,621 B2 * 12/2015 Cheich ..... B31D 5/0069
9,376,280 B2 * 6/2016 Page ..... B65H 16/005
2003/0173451 A1 * 9/2003 Inana ..... B65H 16/06 242/578.2
2008/0141620 A1 * 6/2008 Szabo ..... B29C 65/086 53/79
2011/0114778 A1 * 5/2011 Andersson ..... A47K 10/40 242/160.1
2011/0309125 A1 * 12/2011 Kuchar ..... B31D 3/002 226/195
2012/0043409 A1 * 2/2012 Takei ..... B65H 19/126 242/599
2012/0223179 A1 * 9/2012 Galindo Gonzalez . B65H 49/32 242/598.5
2014/0116851 A1 * 5/2014 Huang ..... B65H 23/1806 198/750.1
2015/0140265 A1 * 5/2015 Page ..... B31D 5/0065 428/136
2016/0130104 A1 * 5/2016 Page ..... B65H 16/005 242/594

OTHER PUBLICATIONS

International Preliminary Report on Patentability and Written Opinion of the International Searching Authority relating to corresponding International Application No. PCT/US2013/050672, dated Jan. 20, 2015.

* cited by examiner 18
20
16
14
14b
14a
94
60b
80b
80c
80
80a
60
40b
41
74
76
70
70b
72
60a
70e
54
54b
50a
50
54a
52
44
42
43
40
42a
44a
41
34d
34b
34e
34
13d
12d
34a
32
13a
13b
12b
12e
34d
30a
30
12a
13c
30b
12c

APPARATUS AND METHOD FOR DISPENSING CUSHIONING WRAP MATERIAL

RELATED APPLICATION

This application is a national phase of International Application No. PCT/US2013/050672, filed Jul. 16, 2013, and published in English as WO 2014/014905 A1, on Jan. 23, 2014, which claims the benefit of and priority to U.S. Provisional Patent Application No. 61/673,278, filed Jul. 19, 2012, the disclosure of which is incorporated herein by reference as if set forth in its entirety.

FIELD OF THE INVENTION

The present invention relates generally to packing materials and, more particularly, to packing materials for wrapping articles.

BACKGROUND

When shipping an article from one location to another, the article is typically placed in a container along with protective packaging material to fill the voids about the article and to cushion the article during the shipping process. A common protective packaging material is a cellular foam polystyrene (e.g., STYROFOAM®, The Dow Chemical Corporation, Midland, Mich.) product having a peanut shape, and commonly referred to as "packing peanuts." However, the performance and ecological disadvantages of plastic packing peanuts as a void fill material is well known. The plastic material is not easily biodegradable when in a landfill and, although the plastic material can be recycled through reuse, such recycling programs have met with limited success. Moreover, articles within a package and surrounded by plastic packing peanuts may migrate within the package. Thus, an article centered within a box when packaged, may move next to a side wall of the shipping container when transported, which may lead to damage to the article during shipment.

While a variety of products have been designed to provide a void fill substitute for plastic packing peanuts, each of the products has drawbacks. For example, starch products have been used, but tend to be excessively dusty and frangible. Products made from corn husks and other vegetation, are prone to attracting vermin, rodents, and the like.

Bubble wrap is a plastic packaging product that consists of small spheres of air bubbles. Unfortunately, bubble wrap has many negative aspects. For example, the polymer film used in bubble wrap is considered ecologically toxic because it can take hundreds of years to disintegrate in landfills. In addition, because of the air bubbles, bubble wrap is bulky and can cause storage problems.

Slit sheet paper packing material is an alternative, ecologically-friendly packing material that increases in thickness when stretched. This stretching and increase in thickness of the slit sheet paper packing material is referred to as expansion. Slit sheet paper packing material typically includes a durable paper with consecutive rows of slits cut into the paper. The thickness of the slit sheet paper packing material can increase by an order of magnitude, or more, relative to its original thickness, when stretched. This increased thickness allows the expanded material to serve as a protective cushioning wrap material for articles. Slit sheet paper packing material, and the manufacturing thereof, are described in greater detail in U.S. Pat. Nos. 5,667,871 and 5,688,578, the disclosures of which are incorporated herein by reference in their entireties. Typically, a cushion wrap material formed with expanded slit sheet packing material includes a lightweight tissue paper that acts as a separator sheet between layers of the expanded material. The tissue paper prevents openings in the expanded paper from becoming undesirably interlocked.

Traditionally, an electric powered machine is used to expand and dispense slit sheet packing material for an operator to wrap around an object or around itself. When in operation, the slit sheet packing material is expanded inside of the machine and dispensed from the front of the machine with an unexpanded separator sheet. Unfortunately, the size of these dispensing machines typically requires a large amount of table space and vertical space above the table. In addition, the weight of these dispensing machines typically prohibits the machine from being easily moved, even over short distances. Moreover, the requirement that the dispensing machine be located near a power outlet can limit the possible places that the dispensing machine can be located. Furthermore, the mechanical components of these dispensing machines eventually wear and must be replaced or repaired.

U.S. Patent Application Publication No. 2011/0309125 describes a dispensing mechanism that deploys a roll of web material having slit cuts and expands it into a web with a cellular structure. The mechanism mounts a roll of unexpanded web material on an axle that is positioned at a first angle to a guide wheel assembly. The first angle is not perpendicular to the direction of deployment and the material moves through the guide wheel assembly longitudinally in such a way that tension is applied at a second angle to the direction of deployment. This diagonal tension causes the web material to expand and form cells. However, the guide wheels that are used to apply tension to the material only contact a small portion of the material on one side. This limited and offset contact may cause uneven expansion of the slit sheet material.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

According to some embodiments of the present invention, an unpowered, manually operable apparatus for dispensing cushioning wrap material includes a frame, a roll of interleaf material rotatably secured to the frame, a roll of expandable sheet material in an unexpanded form rotatably secured to the frame adjacent the roll of interleaf material, and a tensioning assembly operably associated with the roll of expandable sheet material to control rotational resistance thereof. The rotational resistance causes the expandable sheet material to expand in length and thickness as it is pulled with the interleaf material by a user. Typically, the roll of interleaf material and the roll of expandable sheet material are secured to the frame such that respective longitudinal centerlines of each roll are substantially aligned. In addition, typically, the axial directions of the rolls are substantially parallel.

In some embodiments of the present invention, the frame includes a pair of opposing brackets that extend upwardly from the frame. Each bracket has an open ended, elongated slot formed therein. The roll of interleaf material includes a hollow, axially-extending core and is rotatably secured to the frame via an elongated rod extending through the core. The elongated rod includes opposite end portions, and each end portion is received within a respective slot. The open end of each bracket slot is configured to inhibit unintentional removal of a respective rod end portion from the bracket slot.

In some embodiments of the present invention, the elongated rod includes a first pair of spaced-apart stops that limit axial movement of the rod relative to the brackets. The elongated rod also includes a second pair of spaced-apart stops located between the first pair of stops, and that are configured to limit axial movement of the roll of interleaf material supported by the rod.

In some embodiments of the present invention, the frame includes a pair of opposing supports that extend upwardly from the frame in adjacent, spaced-apart relationship with the pair of opposing brackets. The roll of expandable material is rotatably secured to the supports.

The roll of expandable sheet material includes a hollow, axially-extending core. The tension assembly includes an elongated rod with opposite end portions that extends through the hollow core. Each end portion of the elongated rod is secured to a respective one of the supports. A first core plug is attached to one end portion of the rod and includes opposite first and second end portions, and a radially outwardly directed flange adjacent the first core plug first end portion. The first core plug second end portion extends into one end of the hollow core. A second core plug is attached to an opposite end portion of the rod and includes opposite first and second end portions, and a radially outwardly directed flange adjacent the second core plug first end portion. The second core plug second end portion extends into an opposite end of the hollow core. An adjustment mechanism is operably associated with the second core plug and is configured to exert an adjustable compressive force on the roll of expandable sheet material to thereby control rotational resistance of the roll of expandable sheet material.

Typically, the width of the roll of interleaf material has a width less than a width of the expanded sheet material in an expanded form such that opposite, longitudinally-extending side edge portions of the expanded sheet material are exposed. For example, a width of the roll of interleaf material may be up to about 50% less than a width of the roll of expanded sheet material. However, in some embodiments, the roll of interleaf material may have a width that is substantially the same as a width of the roll of expanded sheet material. As such, embodiments of the present invention may include a roll of interleaf material with a width equal to or about 50% less than a width of a roll of expanded sheet material.

In some embodiments of the present invention, the expandable sheet material includes a slit pattern which forms an array of openings (e.g., hexagonal openings, diamond-shaped openings, etc.) when the expandable sheet material is in an expanded form.

In some embodiments of the present invention, the expanded sheet material and interleaf material are paper sheet materials (e.g., any type of paper, as well as non-woven fibrous sheet materials, woven fibrous sheet materials, etc.) For example, the expanded sheet material may be die-cut slit paper, and the interleaf material may be tissue paper.

According to other embodiments of the present invention, a method of dispensing cushioning wrap material from an unpowered, manually operable apparatus includes concurrently manually pulling interleaf material from a first roll rotatably secured to a frame and expandable sheet material in an unexpanded form from a second roll rotatably secured to the frame while maintaining rotational resistance of the second roll such that the expandable sheet material expands to a proper expanded form in thickness and in length, and such that the interleaf material and expandable sheet material in expanded form are in abutting face-to-face contact. The rotational resistance of the second roll of expandable sheet material can be adjusted via a tensioning assembly that is operably associated with the second roll and the frame such the expandable sheet material in its expanded form has a desired width.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate some exemplary embodiments. The drawings and description together serve to fully explain the exemplary embodiments.

DETAILED DESCRIPTION

Figure 1:
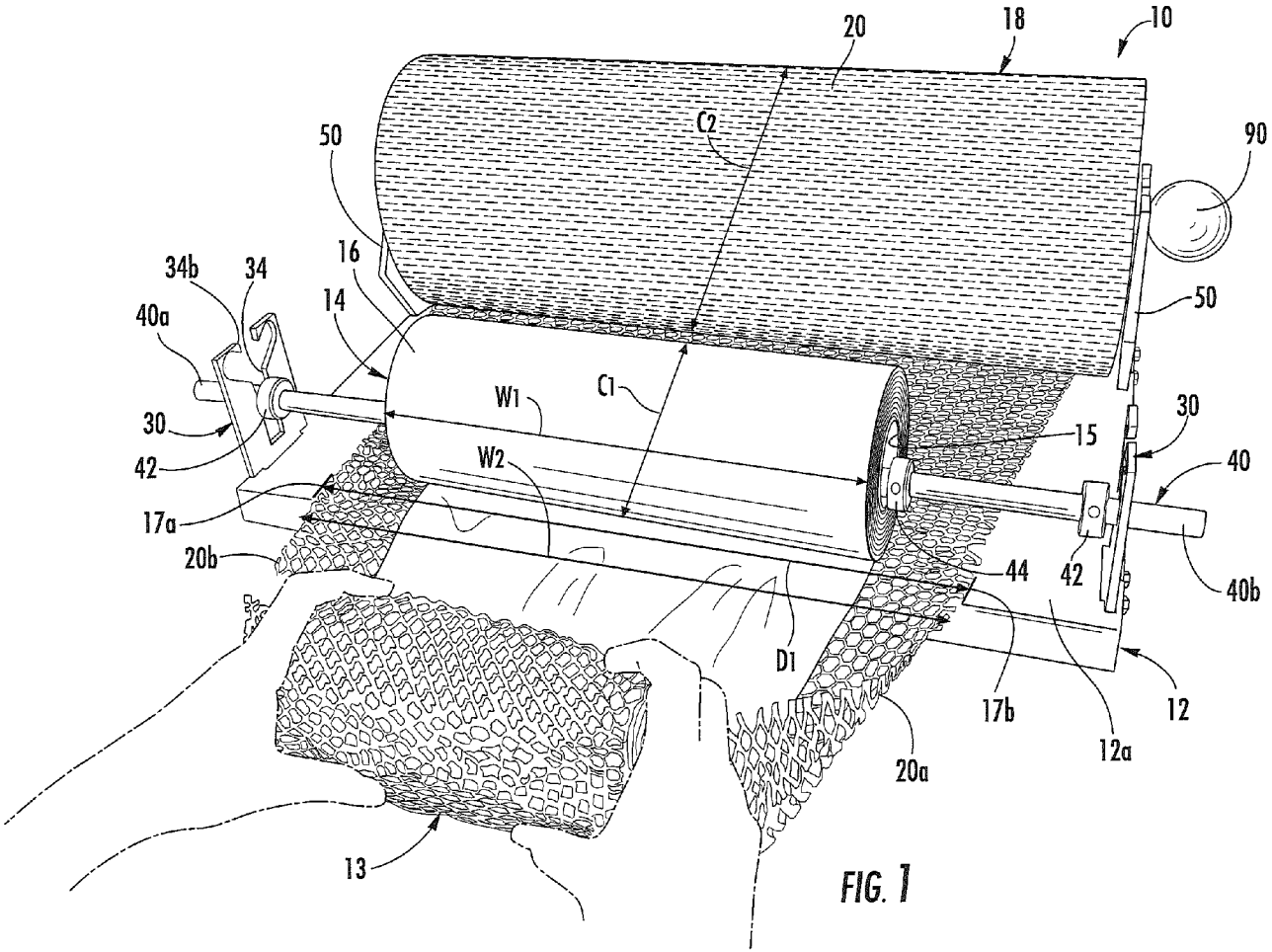
FIG. 1 is a front perspective of an apparatus for dispensing cushioning wrap material, according to some embodiments of the present invention.
Figure 2:
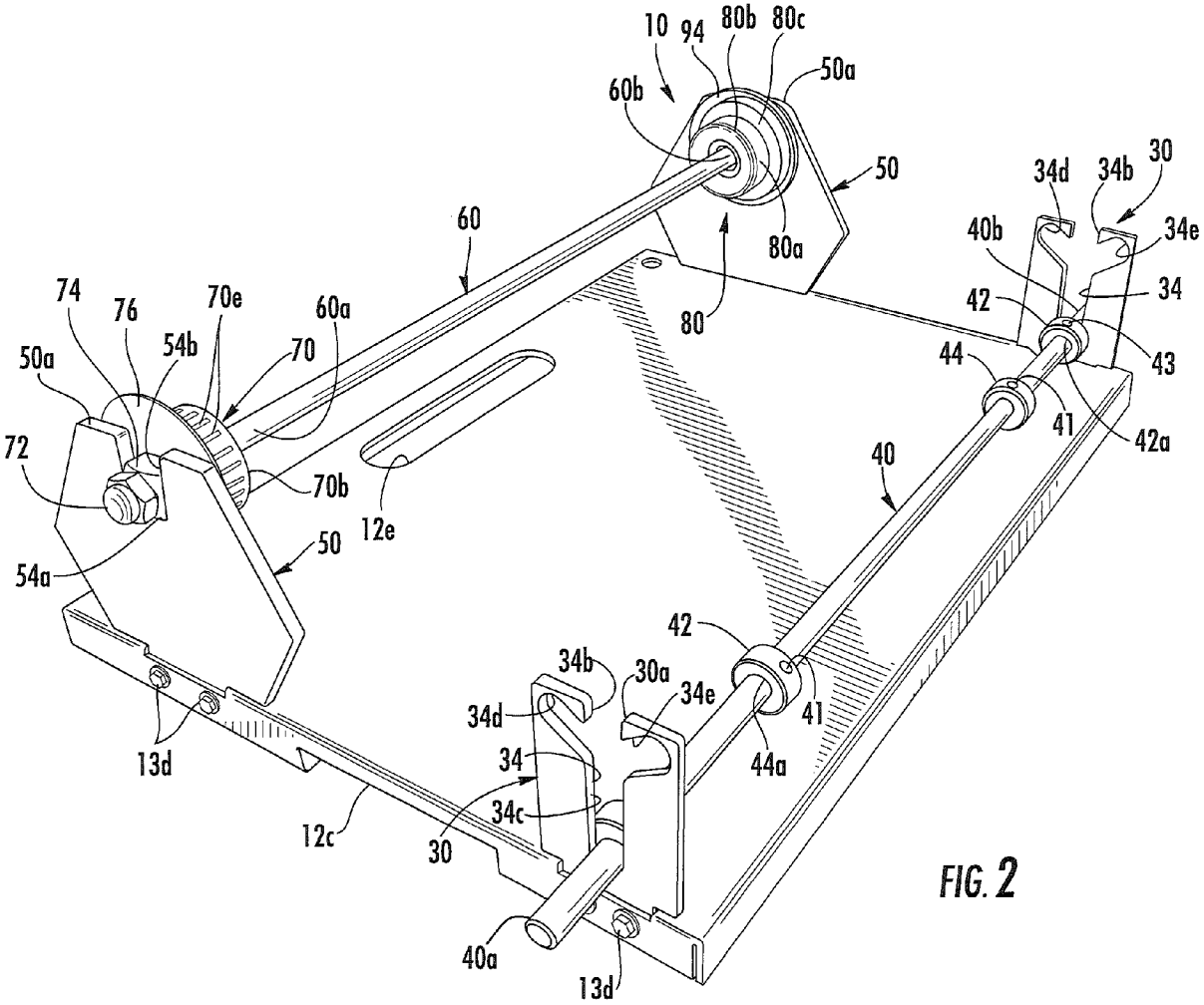
FIG. 2 is a side perspective view of the apparatus of FIG. 1 with the roll of interleaf material and roll of expandable sheet material omitted.
Figure 3:
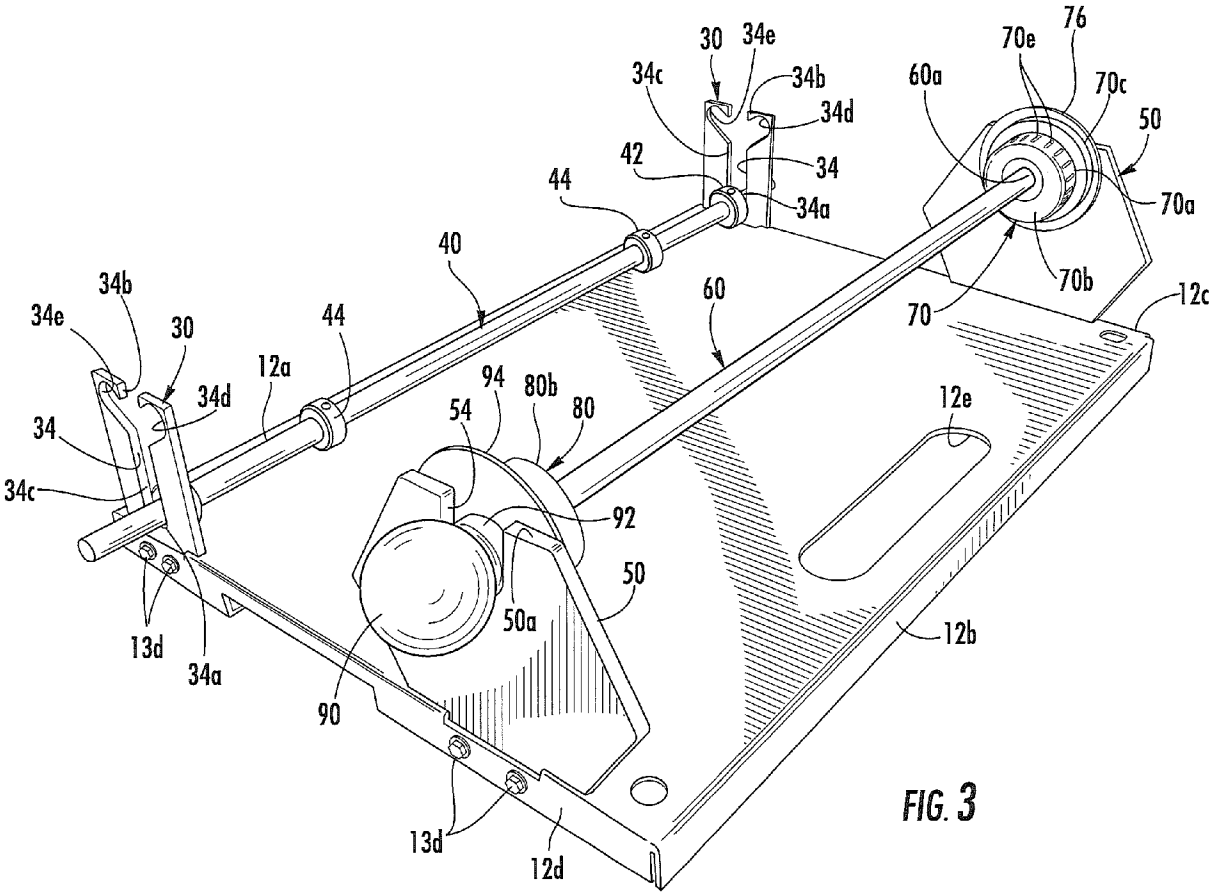
FIG. 3 is a side perspective view of the apparatus of FIG. 1 opposite that from FIG. 2.

The present invention now is described more fully hereinafter with reference to the accompanying drawings, in which some embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The term "about", as used herein with respect to a value or number, means that the value or number can vary by +/− twenty percent (20%).

The term "longitudinal centerline", as used herein, refers to the centerline of a layer of material that divides the lateral width (i.e., from side edge to side edge) of the layer in two equal halves.

The term "unpowered", as used herein with respect to the dispensing apparatus, means that the apparatus dispensed cushioning wrap material manually and without the aid of electrical or other sources of power.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Referring now to FIGS. 1-3 and 4A-4B, an apparatus 10 for dispensing eco-friendly cushioning wrap material 13, according to some embodiments of the present invention, is illustrated. The apparatus 10 includes a frame 12, a roll 14 of interleaf material 16 rotatably secured to the frame 12, and a roll 18 of expandable sheet material 20 in an unexpanded form rotatably secured to the frame 12 adjacent the roll 14 of interleaf material 16. When dispensed, the expandable sheet material 20 in an expanded form and the interleaf material 16 combined form the cushioning wrap material 13. In the illustrated embodiment, the expandable sheet material includes a slit pattern which forms an array of openings (e.g., hexagonal openings) when the expandable sheet material is stretched to an expanded form.

In some embodiments of the present invention, the expandable sheet material 20 and interleaf material 16 are paper sheet materials. For example, the expanded sheet material 20 may can be a die-cut slit paper, such as described in U.S. Pat. Nos. 5,667,871 and 5,688,578, and the interleaf material can be tissue paper. The expandable sheet material 20 may be any of various types of expandable sheet materials (e.g., any type of paper, as well as non-woven fibrous sheet materials, woven fibrous sheet materials, etc.). The interleaf material 16 may be any of various types of sheet materials (e.g., any type of paper, as well as non-woven fibrous sheet materials, woven fibrous sheet materials, etc.). Embodiments of the present invention are not limited to paper sheet materials. Other sheet materials including, but not limited to, polymeric materials and foil may also be utilized.

Typically, the width $W_1$ of the roll 14 of interleaf material 16 is less than a width $W_2$ of the expanded sheet material 20 in an unexpanded and expanded form such that opposite, longitudinally-extending side edge portions 20*a*, 20*b* of the expandable sheet material 20 are exposed. For example, in some embodiments of the present invention, the width $W_1$ of the roll 14 of interleaf material 16 may be up to about 50% less than a width of the roll of expanded sheet material. When an article is wrapped in the cushioning wrap material 13, openings in the exposed edge portions 20*a*, 20*b* of the expanded sheet material 20 can interlock with each other to help maintain the cushioning wrap material 13 in a wrapped state. However, in some embodiments, the roll of interleaf material may have a width that is substantially the same as a width of the roll of expanded sheet material. As such, embodiments of the present invention may include a roll 14 of interleaf material 16 with a width $W_1$ equal to or about 50% less than a width $W_2$ of a roll 18 of expandable sheet material 20.

The illustrated frame 12 has a generally rectangular shape with opposite front and rear portions 12*a*, 12*b* and opposite side portions 12*c*, 12*d*. However, embodiments of the present invention are not limited to the rectangular-shaped frame 12. The frame 12 may have various shapes and configurations. The illustrated frame 12 also includes a slot 12*e* formed therein to facilitate user manipulation of the frame, user carrying of the frame, etc.

A pair of opposing brackets 30 extend upwardly from the frame 12 adjacent the frame front end portion 12*a*. In some embodiments, each bracket 30 includes opposite end portions 30*a*, 30*b* with end portion 30*b* configured to be inserted within a respective slot 13*a* formed in the frame 12. End portion 30*b* of each bracket 30 also includes a pair of threaded openings 32 formed therein. When the bracket end portion 30*b* is inserted within slot 13*a*, the threaded openings 32 align with corresponding threaded openings 13*c* in the respective frame side portions 12*c*, 12*d*. Threaded fasteners 13*d*, such as bolts or screws, threadingly engage the aligned threaded openings 13*c*, 32 to secure each bracket 30 to the frame 12. However, other ways of attaching the brackets 30 to the frame 12 may be utilized such as, but not limited to, press fit, welding, brazing, adhesives, and the like. Moreover, in some embodiments of the present invention, the frame 12, brackets 30, and supports 50 (described below) may be formed as a single structure, such as a unitary monolithic molded polymeric body.

In some embodiments, each bracket 30 includes an upwardly extending elongated slot 34 with a closed end 34*a* and an opposite open end 34*b*. Each slot 34 includes a first portion 34*c* that extends upwardly from the closed end 34*a*, and second and third portions 34*d*, 34*e* adjacent the open end 34*b* that are angled relative to the first portion 34*c*. As will be described below, during use of the apparatus 10, each slot 34 is configured to inhibit unintentional disengagement or removal from the frame 12 of the rod 40 that supports the roll 14 of interleaf material 16. However, other ways of preventing unintentional disengagement or removal from the frame 12 of the rod 40 may be utilized, such as a locking mechanism placed over the open upper end 34*b* of bracket slot 34, etc.

The roll 14 of interleaf material 16 includes a hollow, axially-extending core 15 and is supported on the frame 12 by an elongated rod 40 that extends through the hollow core 15. The rod 40 includes opposite end portions 40*a*, 40*b*. The roll 14 of interleaf material 16 is attached to the frame 12 by lowering each end portion 40*a*, 40*b* of the rod 40 through the open end 34*b* of a respective bracket slot 34. The rod 40 includes a first pair of spaced-apart stops 42 that limit axial movement of the rod 40 relative to the brackets 30. Each stop 42 in the illustrated embodiment is generally cylindrical and has a hollow, axially-extending core 42*a* through which the rod 40 can be inserted. Each stop 42 can be secured to the rod 40 via a set screw 43 that threadingly engages a threaded passage 41 in the stop 42, as would be understood by one skilled in the art. Accordingly, the position of each stop 42 on the rod 40 can be user adjustable.

The illustrated rod 40 also includes a second pair of spaced-apart stops 44 that are located between the first pair of stops 42. The stops 44 are configured to limit axial movement of the roll 14 of interleaf material 16 supported by the rod 40. Similar to stops 42, each stop 44 is generally cylindrical and has a hollow, axially-extending core 44*a* through which the rod 40 can be inserted. Each stop 44 is secured to the rod 40 via a set screw 43 that threadingly engages a threaded passage 41 in the stop 44, as would be understood by one skilled in the art. Accordingly, the position of each stop 44 on the rod 40 can be user adjustable. Typically, the stops 44 are positioned on the rod 40 such that the longitudinal centerline $C_1$ of the roll 14 is substantially aligned with a longitudinal centerline $C_2$ of the roll 18.

During use of the apparatus 10, when a user pulls the interleaf material 16 from the roll 14, the rod 40 may have the tendency to rise upwardly in the slots 34 of brackets 30. The configuration of each slot 34, specifically the slot portions 34*d*, 34*e* are configured to trap a respective end portion 40*a*, 40*b* of the rod 40, thereby inhibiting unintentional removal of the rod 40 and roll 14 of interleaf material 16 from the frame 12.

A pair of supports 50 extend upwardly from the frame 12 adjacent the frame rear end portion 12*b*. In some embodiments, each support 50 includes opposite end portions 50*a*, 50*b* with the end portion 50*b* configured to be inserted within a respective slot 13*b* formed in the frame 12. End portion 50*b* of each support 50 also includes a pair of threaded openings 52 formed therein. When the support end portion 50*b* is inserted within slot 13*b*, the threaded openings 52 align with corresponding threaded openings 13*c* in the respective frame side portions 12*c*, 12*d*. Threaded fasteners 13*d*, such as bolts or screws, threadingly engage the aligned threaded openings 13*c*, 52 to secure each support 50 to the frame 12. However, other ways of attaching the supports 50 to the frame 12 may be utilized such as, but not limited to, press fit, welding, brazing, adhesives, and the like. As described above, in some embodiments of the present invention, the frame 12, brackets 30, and supports 50 may be formed as a single structure, such as a unitary monolithic molded polymeric body.

Each support 50 includes a slot 54 formed therein with a closed end 54*a* and an opposite open end 54*b*. Each slot 54 is configured to receive a respective end portion 60*a*, 60*b* of an elongated rod 60 that rotatably supports the roll 18 of expandable sheet material 20. The end portions 60*a*, 60*b* are threaded to threadingly engage an adjustment knob 90 and a pair of nuts 72, 74, as described below. The supports 50 are arranged on the frame 12 relative to the brackets 30 such that the axial directions $A_1$, $A_2$ (FIG. 4B) of the rolls 14, 18 are substantially parallel.

Figure 4A:
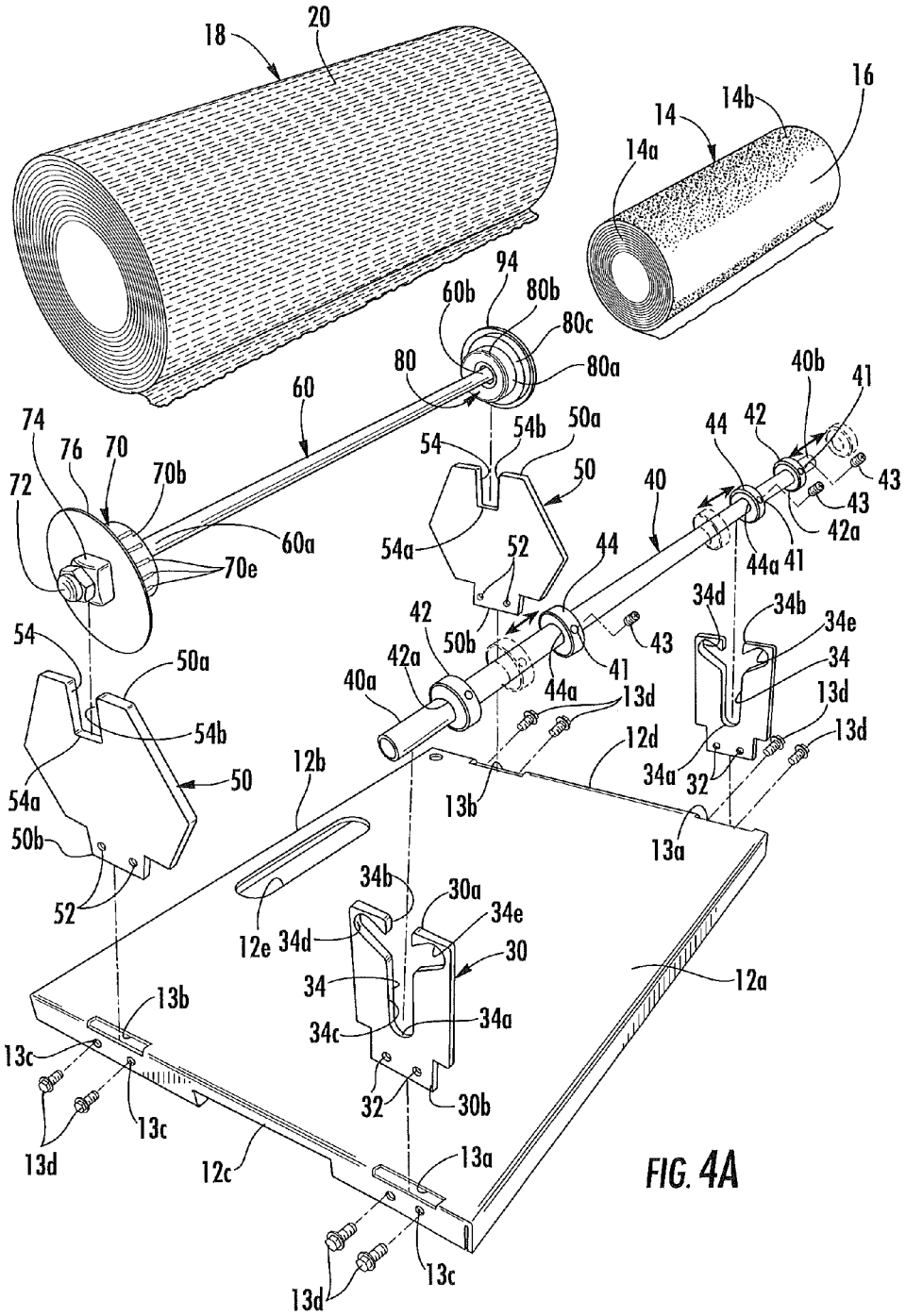
FIG. 4A is an exploded perspective view of the apparatus of FIG. 1.
Figure 4B:
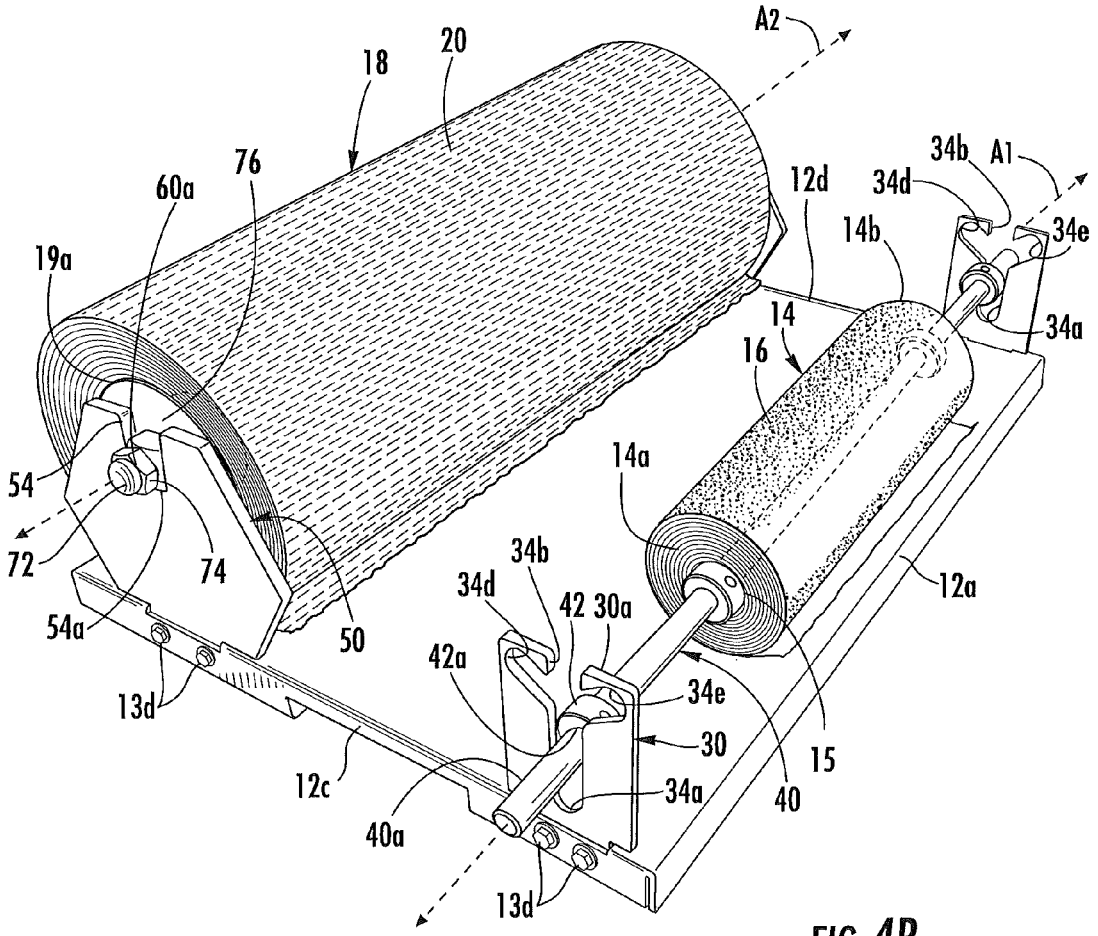
FIG. 4B is a perspective view of the apparatus of FIG. 4A illustrating the roll of interleaf material secured to the frame via the pair of brackets and illustrating the roll of expandable sheet material secured to the frame via the supports.

The roll 18 of expandable sheet material 20 has a hollow, axially-extending core 19 through which the elongated rod 60 extends. In some embodiments, as shown in FIGS. 4A and 4B, for example, a first core plug 70 is attached to rod end portion 60*a* and includes opposite first and second end portions 70*a*, 70*b*, and a radially outwardly directed flange 70*c* (FIG. 3) adjacent the first core plug first end portion 70*a*. The first core plug second end portion 70*b* extends into a first end 19*a* of the hollow core 19 of the roll of expandable sheet material 20. The first core plug 70 can also include a plurality of elongated raised portions 70*e* in circumferentially-spaced apart relationship, as illustrated, that grip the hollow core 19 of the roll 18. The roll 18 of expandable sheet material 20 is allowed to rotate on the first and second core plugs 70 and 80. Alternatively, either or both core plugs 70, 80 may rotate within the roll 18 of expandable sheet material 20 and either or both core plugs 70, 80 may rotate on the elongated rod 60.

A second core plug 80 is attached to an opposite end portion 60*b* of the rod 60 and includes opposite first and second end portions 80*a*, 80*b*, and a radially outwardly directed flange 80*c* adjacent the first end portion 80*a*. The second core plug second end portion 80*b* extends into an opposite end 19*b* of the hollow core 19 of the roll of expandable sheet material 18.

In some embodiments, an adjustment knob 90 is threadingly engaged with the rod end portion 60*b*. User rotation of the knob 90 causes the second core plug 80 to move further into the hollow core of the roll 18 and thereby exert a compressive force on the roll 18 of expandable sheet material 20. As such, a user can control rotational resistance of the roll 18 of expandable sheet material 20 by rotation of the knob 90. The knob 90, rod 60, and first and second core plugs 70, 80 together serve the function of a tensioning assembly.

Specifically, in the illustrated embodiment, user rotation of the adjustment knob 90 advances the knob 90 down the threaded end 60*b* of the rod 60. As the knob 90 advances, it contacts and presses on a bearing 92. The bearing 92 prevents rotation of the roll 18 from causing the knob 90 to further tighten or to loosen while dispensing expandable sheet material 20. As the knob 90 presses on the bearing 92, the bearing 92 presses on a large flat washer 94. The large flat washer 94 serves to evenly distribute the force resulting from the advancing knob 90. The second core plug 80 then pushes on the roll 18 of expandable sheet material 20. The internal forces cause friction between the surfaces that inhibit the rotation of the roll 18.

The opposite end 60*a* of the rod 60 includes threads. The rod 60 is terminated with an acorn nut 72 and a square nut 74 that threadingly engage the threaded end 60*a*. The acorn nut 72 and the square nut 74 are tightened against each other so that they and the rod 60 are all rigidly attached to each other. Adjacent to the square nut 74 is a large flat washer 76 that evenly distributes the force resulting from tightening the adjustment knob 90 on the opposite end of the roll 18 of expandable sheet material 20. The square nut 74 is received by the square slot 54 in the bracket 50 and prevents the rod 60 and the other components rigidly attached to it from free spinning when the expandable sheet material 20 is dispensed from the roll 18.

The frame 12, brackets 30, and supports 50 may be formed from various materials suitable to provide a substantially rigid base for operation of the rolls 14, 18 of interleaf material 16 and expandable sheet material 20. Exemplary materials include, but are not limited to, iron, steel, carbon steel, alloy steel, stainless steel, aluminum, and/or any combination and/or alloys thereof. Other exemplary materials include plastic and wood. Similarly, the rods 40, 60 may be formed from various materials suitable to provide a substantially rigid member upon which the rolls 14, 18 of interleaf material 16 and expandable sheet material 20 can rotate. Exemplary materials include, but are not limited to, iron, steel, carbon steel, alloy steel, stainless steel, aluminum, and/or any combination and/or alloys thereof. Other exemplary materials include plastic and wood. Moreover, the rods 40, 60 may be hollow or solid.

In the illustrated embodiment of FIGS. 1-3 and 4A-4B, the brackets 30 and supports 50 are arranged on the frame 12 such that the roll 14 of interleaf material 16 is adjacent the front end 12*a* of the frame 12 and such that the roll 18 of expandable sheet material 20 is adjacent the rear end 12*b* of the frame. However, in other embodiments, this orientation can be reversed. For example, as illustrated in FIG. 5, the brackets 30 and supports 50 are arranged on the frame 12 such that the roll 14 of interleaf material 16 is adjacent the rear end 12*b* of the frame 12 and such that the roll 18 of expandable sheet material 20 is adjacent the front end 12*a* of the frame.

Figure 5:
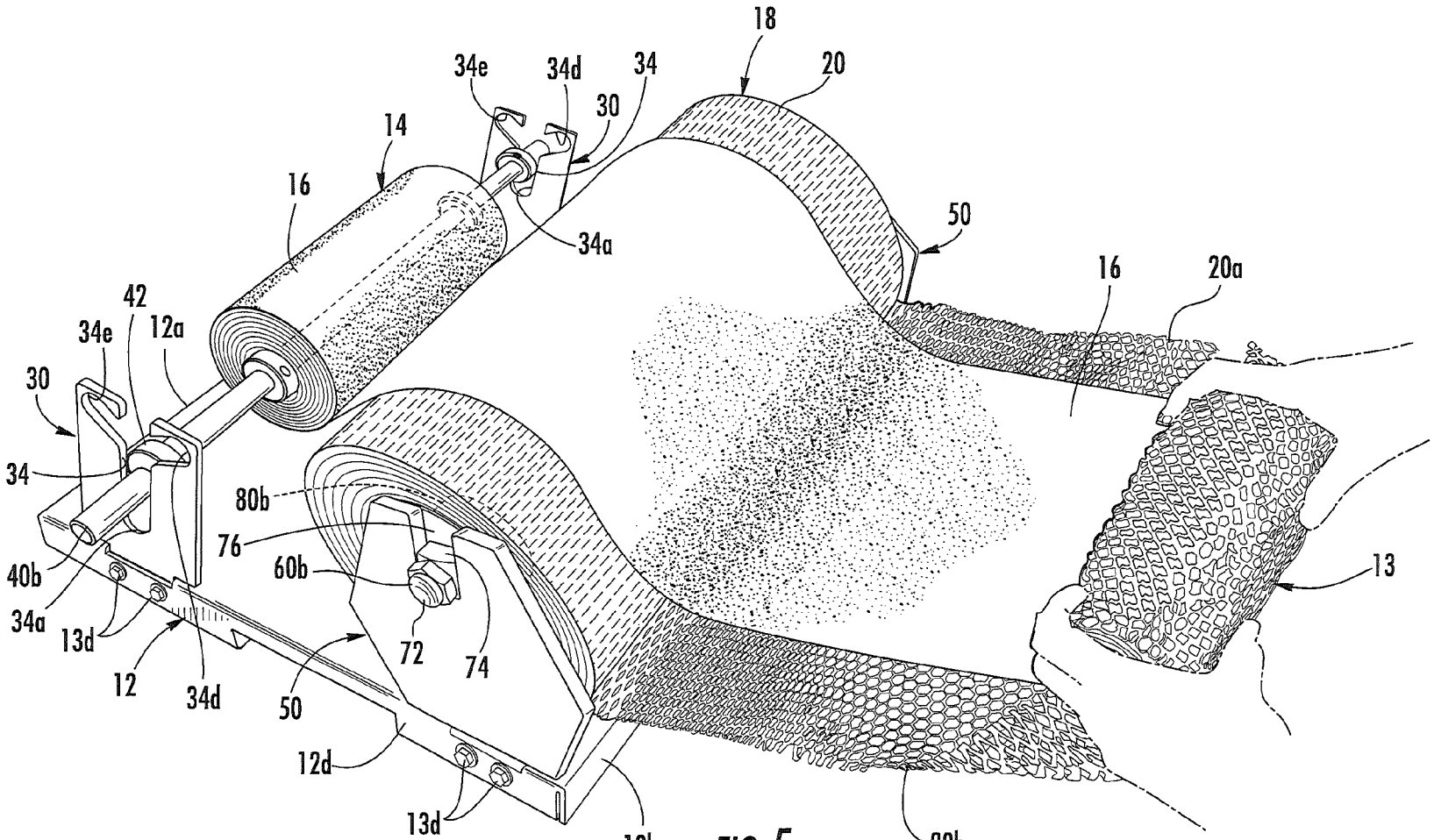
FIG. 5 is a front perspective of an apparatus for dispensing cushioning wrap material, according to other embodiments of the present invention.

In operation, as illustrated in FIGS. 1 and 5, a user simultaneously manually pulls the interleaf material 16 and the expandable sheet material 20 while maintaining rotational resistance of the roll 18 of expandable sheet material 20 such that the expandable sheet material 20 expands to an expanded form in thickness and in length. The user then wraps an article with the cushioning wrap material 13 formed by the combined interleaf material 16 and the expanded sheet material 20 so as to provide protection during packing and shipping.

As illustrated in FIG. 1, in some embodiments of the present invention, the frame 12 includes spaced-apart first and second visual indicia 17*a*, 17*b* adjacent the frame front portion 12*a*. A distance $D_1$ between the first and second visual indicia 17*a*, 17*b* corresponds to a desired width $W_1$ of the expandable sheet material 20 as it is pulled from the roll 18 in a proper expanded shape. If the width of the expandable sheet material 20 as it is pulled from the roll 18 is greater than $W_1$, then the material 20 is not in proper expanded form. Additional rotational resistance to the roll 18 is necessary to reduce the width to $W_1$, and this is accomplished via clockwise rotation of the adjustment knob 90, as described above. If the material 20 tears as it is being pulled from the roll 18, then too much rotational resistance has been applied to the roll 18. The rotational resistance is lessened by counterclockwise rotation of the adjustment knob 90, as described above.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. An unpowered, manually operable apparatus for dispensing cushioning wrap material, the apparatus comprising:

a frame;

a roll of interleaf material secured to the frame for rotation about a longitudinal interleaf axis;

a roll of expandable sheet material extending between opposite ends spaced-apart along longitudinal expandable sheet axis, wherein the roll of expandable material is in an unexpanded form rotatably secured to the frame adjacent the roll of interleaf material for rotation about the longitudinal expandable sheet axis, the longitudinal expandable sheet axis being parallel to the longitudinal interleaf axis; and a tensioning assembly operative to selectively apply a compressive force to the expandable sheet roll ends along an axis parallel to the longitudinal expandable sheet axis to control rotational resistance of the roll of expandable sheet material, wherein the rotational resistance causes the expandable sheet material to expand in length and thickness as the expandable sheet material is pulled with the interleaf material manually by a user.

2. The apparatus of claim 1, wherein the frame includes a pair of opposing brackets extending upwardly from the frame, each bracket having an open ended, elongated slot formed therein, wherein a respective end portion of an elongated member is received within each slot, and wherein the roll of interleaf material is supported by the member.

3. The apparatus of claim 2, wherein the member includes a first pair of spaced-apart stops that limit axial movement of the member when the member ends are received within the bracket slots.

4. The apparatus of claim 3, wherein the member includes a second pair of spaced-apart stops located between the first pair of stops, wherein the second pair of stops limit axial movement of the roll of interleaf material supported by the member.

5. The apparatus of claim 2, wherein the open end of each bracket slot is configured to inhibit unintentional removal of the respective member end portion from the bracket slot.

6. The apparatus of claim 1, wherein the tensioning assembly has an adjustment mechanism to control rotational resistance of the roll of expandable sheet material.

7. The apparatus of claim 1, wherein the frame includes a pair of supports extending from the frame;

the roll of expandable sheet material includes a hollow, axially-extending core, and wherein the tension assembly includes an elongated member having a received portion that extends through the hollow core, the elongated member having opposite end portions, each end portion secured to a respective one of the supports;

a first core plug attached to one end portion of the member, the first core plug including opposite first and second end portions, and a radially outwardly directed flange adjacent the first core plug first end portion, wherein the first core plug second end portion extends into one end of the hollow core;

a second core plug attached to an opposite end portion of the member, the second core plug including opposite first and second end portions, and a radially outwardly directed flange adjacent the second core plug first end portion, wherein the second core plug second end portion extends into an opposite end of the hollow core; and an adjustment mechanism operably coupled to the second core plug and configured to exert the compressive force to opposing end faces of the roll of expandable sheet material to thereby control rotational resistance of the roll of expandable sheet material.

8. The apparatus of claim 1, wherein axial directions of the rolls are parallel.

9. The apparatus of claim 1, wherein a width of the roll of interleaf material is the same or less than a width of the roll of expandable sheet material.

10. The apparatus of claim 1, wherein the expandable sheet material includes a slit pattern which forms an array of openings when the expandable sheet material is in an expanded form.

11. The apparatus of claim 1, wherein the expanded sheet material and interleaf material are paper sheet materials.

12. The apparatus of claim 1, wherein the expanded sheet material is die-cut slit paper, and wherein the interleaf material is tissue paper.

13. The apparatus of claim 1, wherein the frame includes spaced-apart first and second visual indicia, wherein a distance between the first and second visual indicia corresponds to a desired width of the expandable sheet material as the expandable sheet material is dispensed in a proper expanded shape.

14. An unpowered, manually operable apparatus for dispensing cushioning wrap material, the apparatus comprising:

a frame;

a pair of opposing brackets extending upwardly from the frame, each bracket having an open ended, elongated slot formed therein;

a roll of interleaf material including a hollow, axially-extending core, wherein the roll of interleaf material is rotatably secured to the frame via an elongated member having a received portion extending through the core, wherein the elongated member includes opposite end portions, each end portion received within a respective elongated slot, and wherein the open end of each elongated slot is configured to inhibit unintentional removal of the respective member end portion from the elongated slot;

a roll of expandable sheet material in an unexpanded form rotatably secured to the frame adjacent the roll of interleaf material such that the roll of interleaf material and the roll of expandable sheet material are rotatable about parallelly aligned longitudinal axes; and a tensioning assembly operative to selectively apply a compressive force to opposite spaced-apart ends of the expandable sheet material along an axis parallel to the longitudinal axis of the roll of expandable sheet material, wherein the rotational resistance causes the expandable sheet material to expand in length and thickness as the expandable sheet material is pulled with the interleaf material by a user.

15. The apparatus of claim 14, wherein the member includes a first pair of spaced-apart stops that limit axial movement of the member relative to the brackets, and a second pair of spaced-apart stops located between the first pair of stops, wherein the second pair of stops limit axial movement of the roll of interleaf material supported by the member.

16. The apparatus of claim 14, wherein the tensioning assembly has an adjustment mechanism to control rotational resistance of the roll of expandable sheet material.

17. The apparatus of claim 14, wherein the roll of expandable sheet material includes an expandable sheet hollow, axially-extending core, and wherein the tension assembly includes the elongated member that extends through the expandable sheet hollow core, the elongated member having opposite end portions, each end portion secured to a respective support of a pair of opposing supports extending upwardly from the frame;

a first core plug attached to one end portion of the member, the first core plug including opposite first and second end portions, and a radially outwardly directed flange adjacent the first core plug first end portion, wherein the first core plug second end portion extends into one end of the expandable sheet hollow core;

a second core plug attached to an opposite end portion of the member, the second core plug including opposite first and second end portions, and a radially outwardly directed flange adjacent the second core plug first end portion, wherein the second core plug second end portion extends into an opposite end of the expandable sheet hollow core; and an adjustment mechanism operably coupled to the second core plug and configured to exert a compressive force on the roll of expandable sheet material to thereby control rotational resistance of the roll of expandable sheet material.

18. The apparatus of claim 14, wherein the frame includes spaced-apart first and second visual indicia, wherein a distance between the first and second visual indicia corresponds to a desired width of the expandable sheet material as the expandable sheet material is dispensed in a proper expanded shape.

19. A method of dispensing cushioning wrap material from an unpowered apparatus, the method comprising:

concurrently manually pulling interleaf material from a first roll rotatably secured to a frame and expandable sheet material in an unexpanded form from a second roll rotatably secured to the frame while maintaining rotational resistance of the second roll such that the expandable sheet material expands to a proper expanded form in thickness and in length, and such that the interleaf material and expandable sheet material in expanded form are in abutting face-to-face contact; and adjusting the rotational resistance of the second roll of expandable sheet material via a tensioning assembly that selectively applies a compressive force to opposing end faces of the roll of expandable sheet material such the expandable sheet material in its expanded form has a desired width.

20. The method of claim 19, wherein the frame includes spaced-apart first and second visual indicia, wherein a distance between the first and second visual indicia corresponds to a desired width of the expandable sheet material in a proper expanded shape, and the method further comprising adjusting the rotational resistance of the second roll of expandable sheet material via the tensioning assembly such the expandable sheet material in its expanded form has a width that is the same or less than the distance between the first and second visual indicia.

* * * * *